US006267498B1

(12) United States Patent
Lafond et al.

(10) Patent No.: US 6,267,498 B1
(45) Date of Patent: Jul. 31, 2001

(54) DEVICE FOR BLENDING THE CONTENTS OF A BAG

(75) Inventors: Danielle Lafond, Beloeil; Steve Jalbert, Ste-Julie, both of (CA)

(73) Assignee: Labplas Inc., St-Julie (CA)

( * ) Notice: Subject to any disclaimer, the term of this patent is extended or adjusted under 35 U.S.C. 154(b) by 0 days.

(21) Appl. No.: 09/520,373

(22) Filed: Mar. 6, 2000

Related U.S. Application Data

(63) Continuation-in-part of application No. 09/285,023, filed on Apr. 1, 1999, now Pat. No. 6,142,661.

(30) Foreign Application Priority Data

Mar. 5, 1999 (CA) ..... 2265014

(51) Int. Cl.[7] ..... B01F 11/00; B01F 15/00

(52) U.S. Cl. ..... 366/204; 366/197; 366/332; 366/347; 366/349

(58) Field of Search ..... 366/204, 197, 366/332, 348, 347, 349, 208, 333, 334, 335, 209, 210, 211, 199, 207; 604/416, 403

(56) References Cited

U.S. PATENT DOCUMENTS 2,617,782 * 11/1952 Paton et al. .
2,845,929 * 8/1958 Strumia .
3,132,846 * 5/1964 Siddall .
3,543,966 * 12/1970 Ryan .
3,819,158 * 6/1974 Sharpe et al. .
4,049,242 * 9/1977 Porter .
4,550,654 * 11/1985 Hedenberg .
4,590,850 * 5/1986 Hedenberg .
4,795,265 * 1/1989 Dahlberg et al. .
5,243,833 * 9/1993 Coelho et al. .
5,564,829 * 10/1996 Lafond .
5,632,554 * 5/1997 Wang et al. .
5,699,902 * 12/1997 Sperry et al. .
5,727,370 * 3/1998 Sperry .
5,779,974 * 7/1998 Kuzyk .
5,913,603 * 6/1999 Sperry et al. .

* cited by examiner

*Primary Examiner*—Tony G. Soohoo
(74) *Attorney, Agent, or Firm*—Swabey Ogilvy Renault

(57) ABSTRACT

A blending device for mixing the contents of a plastic bag comprises a casing defining a mixing chamber in which are disposed paddles or the like for acting on the bag and mix the contents thereof, and having a pivotable door for providing access to the chamber and positioning a bag and its contents in this chamber. The door includes a lower container which extends inwardly towards the casing such as to be located in the casing's mixing chamber when the door is a closed position such that spillage resulting from a rupture of the bag in the blending machine is collected in the door's bottom container. Preferably, the door can be easily and completely disconnected from the casing the facilitating the cleaning thereof, for instance following a collection by the container thereof of a spillage. Similarly, the paddles can be easily detached from the motor-driven reciprocation shaft which causes the displacement of the paddles against the bag such that the paddles may be completely disconnected from the casing for facilitating the cleaning thereof.

9 Claims, 4 Drawing Sheets

DEVICE FOR BLENDING THE CONTENTS OF A BAG

CROSS-REFERENCE

This application is a Continuation-in-Part of U.S. Ser. No. 09/285,023 filed on Apr. 1, 1999, now U.S. Pat. No. 6,142,661.

BACKGROUND OF THE INVENTION

1. Field of the Invention

The present invention relates to devices for blending, mixing and/or homogenizing the contents of a bag and, more particularly, of a sterile plastic bag holding clinical samples, for instance used in laboratories, in hospitals, in the food industry, etc.

2. Description of the Prior Art

It is well known to provide sterile plastic bags for holding samples, such as the plastic bag disclosed in U.S. Pat. No. 5,564,829 issued on Oct. 15, 1996 to Lafond. In this patent a disposable sterile plastic bag B is disclosed for holding samples in blenders during the mixing thereof, the bag B comprising a two-ply sheet flexible material integrally joined at opposed side edges thereof (or the bag may be made from a tube) and joined at the upper and lower ends thereof respectively by upper and lower heat seals with a sealed sample receiving chamber being defined between the two plastic sheets inwardly of the bag's side edges and upper and lower sealed ends. Inwardly of the upper seal, there is defined a tear-off line transversely across the two sheets and parallelly to the upper seal thereby forming a detachable strip outwardly of the tear-off line. When the sample is ready to be introduced in the bag, the detachable strip is removed from the bag by pulling it so as to cause rupture of the two sheets at the tear-off line. The bag's chamber is thus sterile when the sample is introduced therein and the bag and its contents can then be inserted in a blending machine, also called a homogenizer or a mixer. The bag's sterility does not depend on how the bag is packaged or on the integrity of the packaging's seal as the bag is itself sterile until the detachable strip is removed therefrom, that is until the bag is ready to be used.

Generally, commercial homogenizers or blenders used in laboratories to mix samples include a casing having a door which is pivoted to the casing the which, when open, reveal a chamber in the casing. In this chamber, there is provided paddles that are adapted to be repeatedly displaced by a motor. When the contents of a bag are to be mixed or blended, the door of the homogenizer is opened and the plastic bag and its contents are inserted into the homogenizer's chamber and the door is then closed such as to trap the upper end of the bag between the door and the casing while a lower portion of the bag and its contents are located in the chamber. The door, when closed, traps the upper end of the bag and thus firmly secures the same in a generally upright position in the homogenizer. The homogenizer is then switched on and the paddles, in a reciprocating movement, repeatedly pound the plastic bag and thus cause its contents to mix. After the homogenizer has been switched off, the door is opened and the bag is removed therefrom with the blended sample being now appropriately mixed and, for instance, ready for analysis.

In known homogenizers or blenders, the pivotable door cannot be removed from the rest of the blender. Furthermore, any rupture of the bag in the blender causes its contents to flow into the chamber of the blender and possibly onto the surface on which the homogenizer rests. This requires that the blender be extensively cleaned and there are some contamination risks in the laboratory.

SUMMARY OF THE INVENTION

It is therefore an aim of the present invention to provide an improved device for mixing or blending the contents of a bag and having a pivotable door that can be easily removed from the remainder of the device.

It is also an aim of the present invention to provide an improved device for blending or mixing the contents of a bag and comprising a pivotable door having a container located below the bag, when the latter is secured in the device, such that if the bag ruptures, its contents find their way into the door's container.

It is a further aim of the present invention to provide a device for blending or mixing the contents of a bag comprising an improved paddle driving mechanism which allows a paddle to be detached from a paddle shaft of the driving mechanism such that the paddle can be removed from the device, for instance, for cleaning purposes.

Therefore, in accordance with the present invention, there is provided a blending device for mixing contents of a bag, comprising a casing defining a chamber and comprising a mixer and a door, wherein when a bag is at least partly positioned in said chamber and said door is closed, said mixer may be operated to act on the bag and cause a content thereof to be mixed, said door defining a collection container adapted to extend in said chamber when said door is closed and to extend under the bag, whereby at least most of the contents of the bag spilling therefrom while the bag is in said blending device and said door is closed will be collected by said container.

Also in accordance with the present invention, there is provided a blending device for mixing contents of a bag, comprising a casing defining a chamber and comprising a mixer and a door, wherein when a bag is at least partly positioned in said chamber and said door is closed, said mixer may be operated to act on the bag and cause a content thereof to be mixed said door being removably connected to said causing.

Further in accordance with the present invention, there is provided a blending device for mixing contents of a bag, comprising a casing defining a chamber and comprising a mixer and a door, wherein when a bag is at least partly positioned in said chamber and said door is closed, said mixer comprising at least one paddle, motor means and transmission means mounted to said paddle, said motor means being adapted to impart motion to said transmission means such as to displace said paddle in a cyclic motion, said paddle being adapted to repeatedly act on the bag and cause a content thereof to be mixed, said paddle including a paddle assembly which comprises a detachable locking mechanism for removably mounting said paddle to said transmission means, whereby said paddle may be disconnected from said transmission means and removed from said casing.

BRIEF DESCRIPTION OF THE DRAWINGS

Having thus generally described the nature of the invention, reference will now be made to the accompanying drawings, showing by way of illustration a preferred embodiment thereof, and in which:

FIG. 6 is a vertical cross-sectional side view similar to that of FIG. 5 but embodying a novel paddle removal mechanism.

DESCRIPTION OF THE PREFERRED EMBODIMENTS

Figure 1:
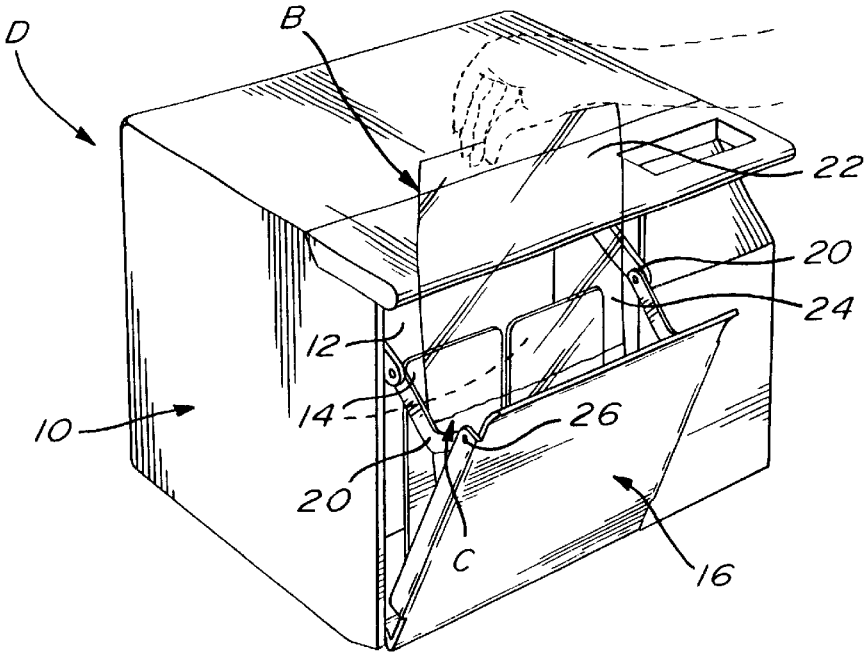
FIG. 1 (PRIOR ART)
FIG. 1 is a perspective view of a conventional device for blending the contents of a bag with a pivotable door thereof being shown in an open position thereof and with a bag being illustrated as it is positioned in the blending device.
Figure 2:
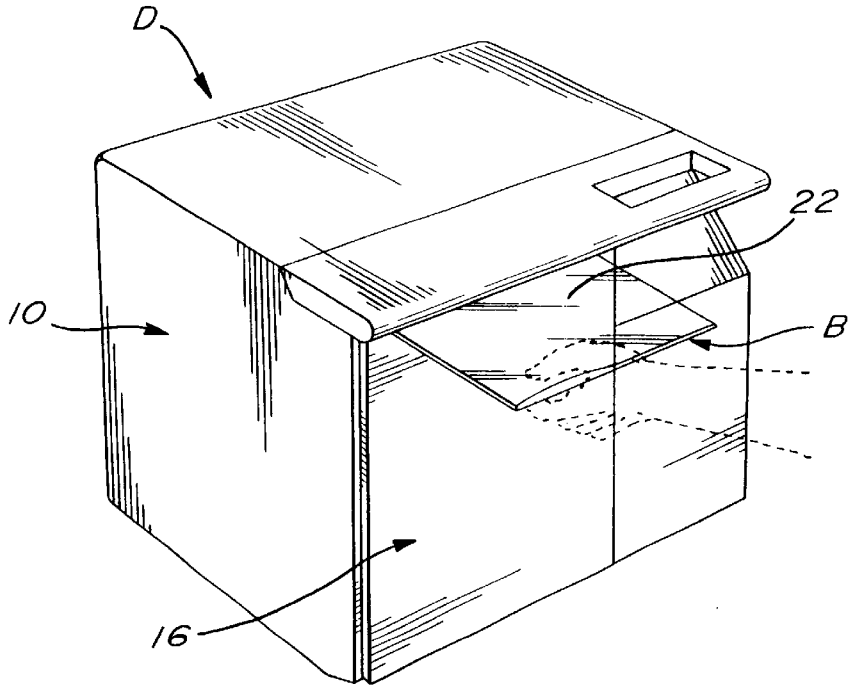
FIG. 2 (PRIOR ART)
FIG. 2 is a perspective view similar to FIG. 1 but showing the conventional blending device with its door in a closed position thereof, an upper portion of the bag extending outwardly of the blending device with a lower portion thereof and the bag's contents being located in the blending machine.
Figure 3:
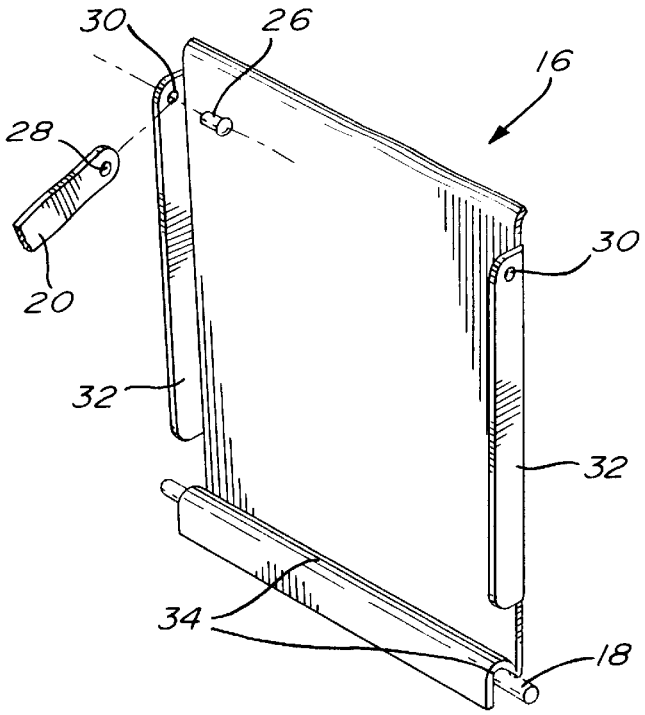
FIG. 3 (PRIOR ART)
FIG. 3 is a rear perspective view of the door of the conventional blending device of FIG. 1.

FIGS. 1 and 2 illustrate a blending device D of the prior art and comprising a casing 10 defining an inner chamber 12 in which are located a pair of paddles 14. The paddles 14 are actuated such as to displace in a reciprocating manner for reasons which will become apparent hereinbelow. Access to the chamber 12 is provided by a door 16 which is pivotally mounted at its bottom around a rod 18, as seen in FIG. 3. The upper end of the door 16 is pivotally mounted to the casing 12 by way of a pair of articulated linkages 20 which allow the door 16 to be pivoted about the rod 18 between open and closed positions, as shown respectively in FIGS. 1 and 2. When the door 16 is open, a flexible bag B may be introduced in the chamber 12, between the paddles 14 and the door 16, as well illustrated in FIG. 1. The bag B has a content C which is located opposite the paddles 14. When the door 16 is closed, as in FIG. 2, an upper portion 22 of the bag B is trapped between the door 16 and the casing 10 with a lower portion 24 of the bag B (see FIG. 1) including its contents C being located in the chamber 12. Therefore, switching on the blending device D results in the displacement of the paddles 14 which repeatedly pound on the bag B such as to mix the contents C thereof.

As seen in FIG. 3, the door 16 is fixedly mounted to the linkages 20 (only part of one of which is shown in FIG. 3) by way of a pin 26, or rivet, which engages a hole 28 defined in the linkage 20 and which also engages a hole 30 defined in a respectively one of the two side flanges 32 of the door 16. The lower end of the door 16 defines a fold 34 which engages by gravity the rod 18. It is therefore possible to displace the door 16 and the linkages 20 pivotally attached thereto in such a manner as to raise the door 16 cut of engagement with the rod 18 with the door 16 being then pivoted above the blending device D. In this position, which is not illustrated, easy access is provided to the paddles 14 and to the blending chamber 12 and this also allows the blending device D to be easily cleaned.

It must be noted that the above conventional blending device D becomes dirtied and possibly contaminated by any accidental spillage of the contents C of the bag B while the latter is in the blending device D. Indeed, if for instance during the blending of the contents C of the bag B under the repeated action of the reciprocating paddles 14, the bag B tears or ruptures, its contents C, or a portion thereof, may spill in the blending device D and also possibly on the surface onto which rests the blending device D and is may cause the contamination of the blending device D and/or the room in which it is located. Furthermore, the door 16 cannot be completely detached from the casing 10.

Therefore, in accordance with the present invention, the blending device D of FIGS. 1 and 2 has been modified and, more particularly, the door 16 and the linkages 20 of the conventional blending device D have been replaced by a new door 40 (made of stainless steel) and associated linkages 42. Each linkage 42 defines at its end 44 which connects to the door 40 a notch 46 such that the linkage end 44 has the form of a hook open at its bottom. The door 40 defines a front wall 48 and a pair of side walls 50 extending inwardly, that is towards the casing 10, from the front wall 48. It must be noted that FIG. 4, as in FIG. 3, is a perspective view which considers the door 40 from the inside, that is outwardly from the casing 10. At the upper end of each side wall 50, there extends inwardly and horizontally a pin 52 provided with a head 54 which is spaced apart from the side wall 50. Therefore, the cylindrical stem of the pin 52 located between the side wall 50 of the door 40 and the head 54 of the pin 52 can be received in the notch 46 of the linkage 42, such that the linkages 42 can be selectively disconnected from the pins 52 and thus from the door 40.

The door 40 also includes a bottom wall 56 and a rear wall 58 which, with a lower portion 60 of the front wall 48 and lower portions 62 of the side walls 50, define a collection container 64 at the lower end of the door 40. When the bag B is in the blending device adapted with the present door 40 and with this door 40 being in a closed positioned similar to that shown in FIG. 2, the lower portion of the bag B and its contents C positioned in the mixing chamber 12 of the blending device are located above the bottom wall 56 of the container 64.

Figure 4:
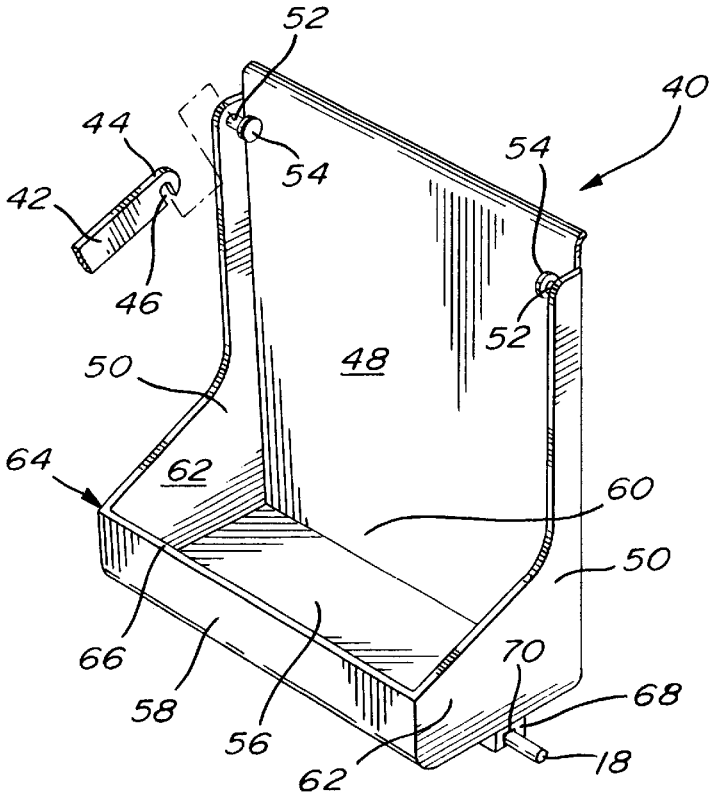
FIG. 4 is a rear perspective view of a door in accordance with the present invention for use in a blending machine also in accordance with the present invention.

An elongated nylon member 68 is secured to the underside of the bottom wall 56 and defines on a lower surface thereof a semi-circular trough 70 which engages the rod 18 fixed to the casing 10. As for the door 16 of FIGS. 1 to 3, the rod 18, albeit shown in both FIGS. 3 and 4, is not part of the door 40 (and of the door 16) as it is fixedly mounted to the casing 10, but is shown herein in FIGS. 3 and 4 for clearly illustrating the engagement of the doors 16 and 40 to this support rod 18. The present door 40 engages by gravity the support rod 18 such that the door 40 can be completely disconnected from the casing 10 by disengaging the linkages 42 from the pins 52 of the door 40 and by elevating the door 40 and thus the elongated member 66 out of engagement with the support rod 18.

Typically, the collection container 64 will be dimensioned such as to be able to collect the full contents of the bag B; for instance, the bags are filled to contain often at most 400 ml substance to be blended, whereby the container 64 is configured to contain slightly more than 400 ml.

Figure 5:
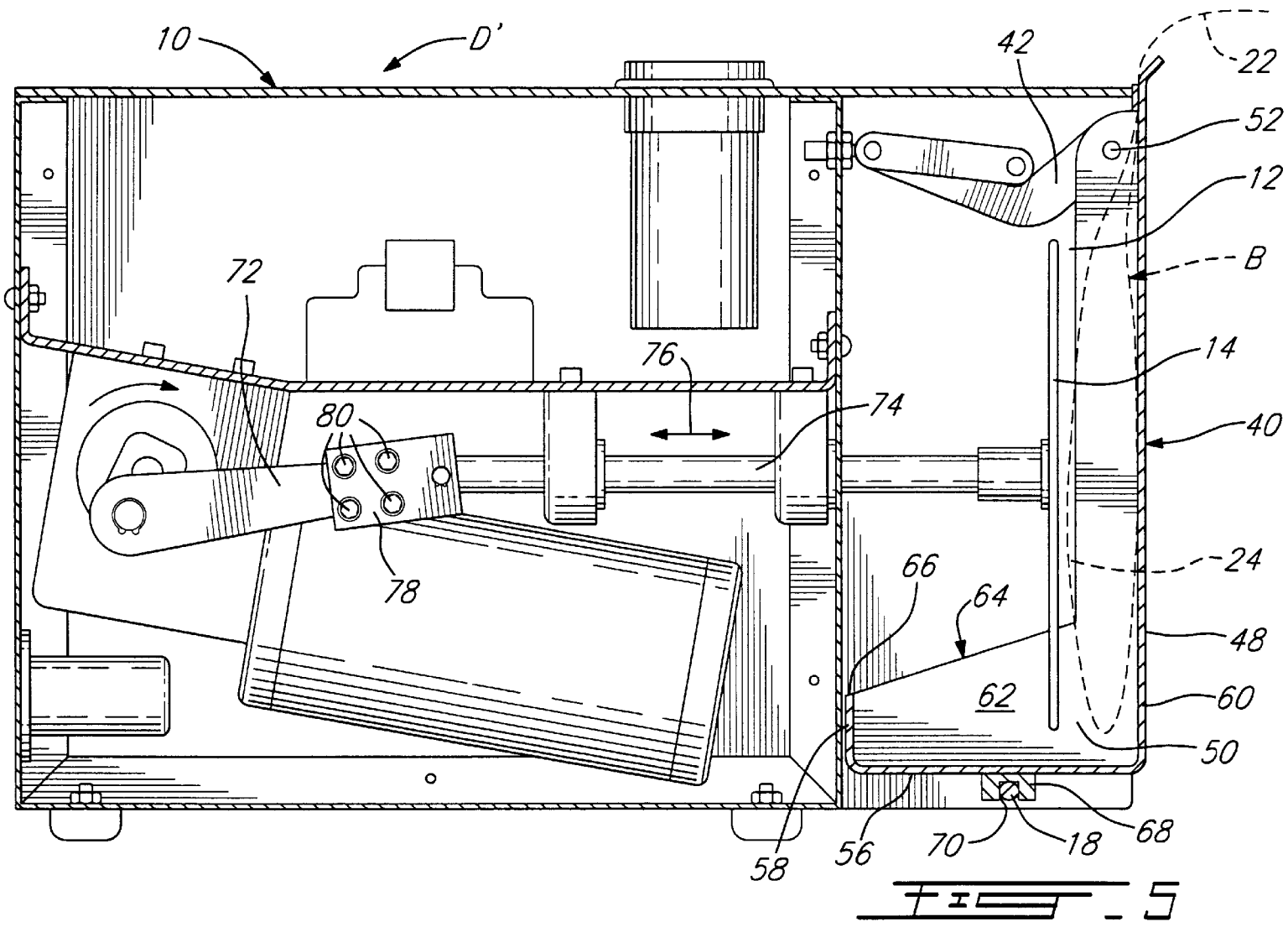
FIG. 5 is a vertical cross-sectional side view of the blending device of FIG. 1 but embodying the novel door of FIG. 4 of the present invention.
Figure 8:
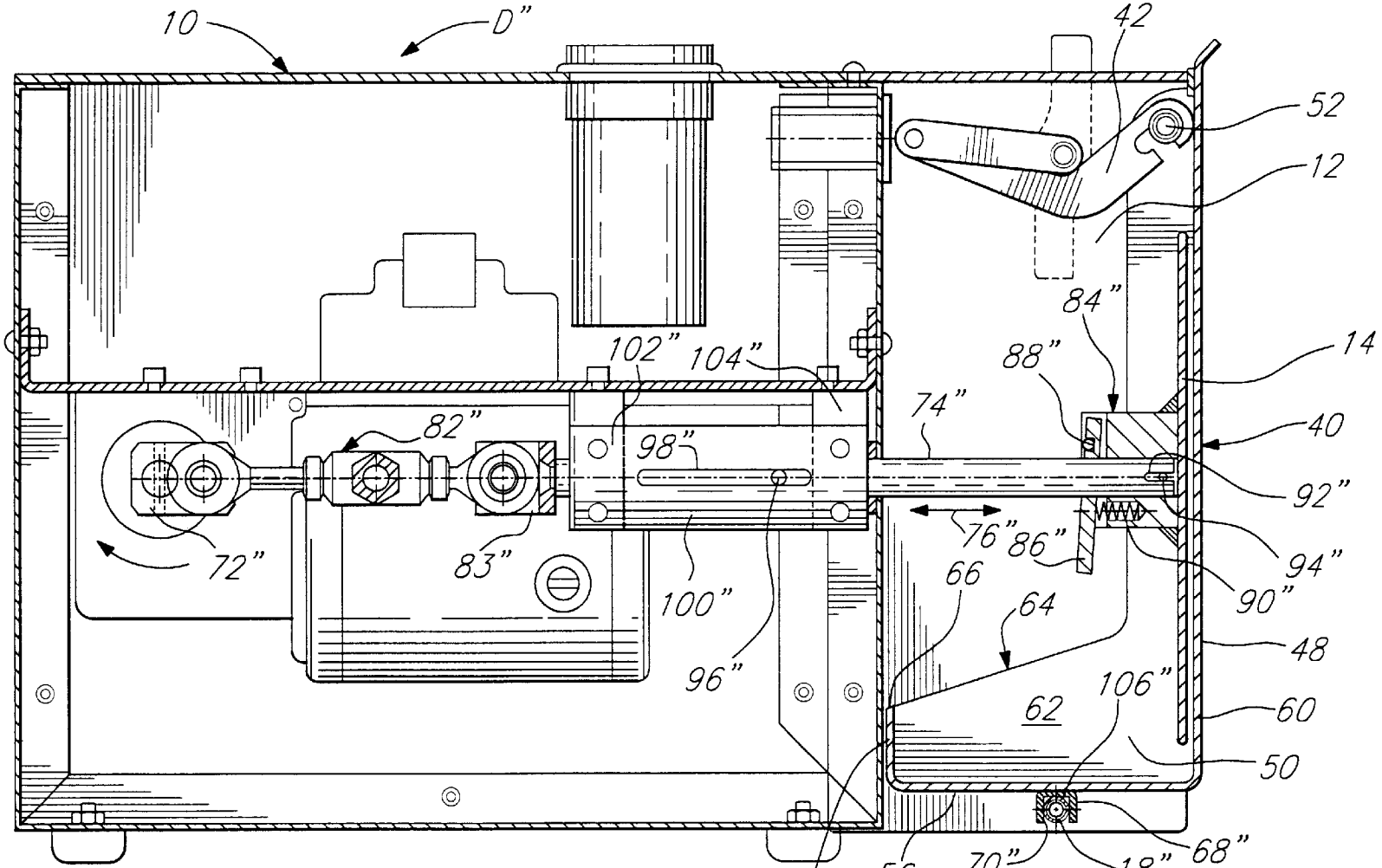

With reference to FIG. 5, the blending device D' of the present invention includes a crank arm 72 pivotally attached to a proximal end of a paddle shaft 74 such as to impart of reciprocation back-and-forth translational displacement to the paddle shaft 74, as per arrows 76. The paddles 14 are mounted to a distal end of the paddle shaft 74. The paddles 14 displace translationally between the front and rear walls 48 and 58 of the door 40 with the bag B hanging between the paddles 14 and the front wall 48 and preferably close to the bottom wall 56. A clamp collar 78, and its screws 80, connect the crank arm 72 of the paddle shaft 74 in an adjustable manner such as to allow for the adjustment of the paddle stroke.

Therefore, with the door 40 of the present invention provided on an otherwise substantially conventional blending device D, any spillage of the contents C of the bag B while the latter is in the blending device is collected in the container 64 and thus does not reach the casing 10 itself and its chamber 12, nor does such a spillage reach the support surface onto which rests the blending device. Following such a spillage, the present door 40 can be disconnected, as described hereinabove, from the casing 10 and completely detached from the remainder of the blending device D such that the spillage collected in the container 64 thereof may be disposed of in an appropriate manner without dirtying the blending device D nor contaminating the same as well as the room in which the blending device is being used. The removability of the door 40 facilitates the cleaning and sterilization of the door 40, for instance following a spillage from a bag B in the container 64 thereof, but the present container 64 could also embodied in a door which cannot be completely disconnected from the casing of the blending device; in such a case, the spillage collected in the container 64 could be removed by other means, such as by suction with the container 64 being then cleaned appropriately while remaining connected to the casing 10. The longitudinal and transversal dimensions of the container 64 are preferably as such that most, if not all at least in most cases, of the spillage from the bag B is collected in the container 64.

With reference to FIG. 6 which shows a variant of FIG. 5, a blending device D" of the present invention includes a crank arm 72" pivotally attached to a double end rod system 82", which is pivotally attached to the paddle shaft linkage device 83" which is attached to the proximal end of a paddle shaft 74", such as to impart a reciprocation back-and-forth translational displacement to the paddle shaft 74", as per arrows 76". A paddle assembly 84", welded to the paddle 14 such that they are both removable from the paddle shaft 74" by means of a self-locking spring loaded floating lever 86", displaces translationally between the front and the rear walls 48 and 58 of the door 40 with the bag B hanging between paddle 14 secured to the removable paddle assembly 84" and the front wall 48, and preferably close to the bottom wall 56. The double end rod system 82" allows for the adjustment of the paddle stroke.

The locking of the removable paddle assembly 84' is achieved by the spring loaded floating lever 86", which lever 86" is attached to the paddle assembly 84" by a tension spring pin 88" and pressured onto the paddle shaft 74" by means of a compression spring 90". The locking action occurs when the outside edge of the spring loaded floating lever 86" grips the paddle shaft 74". The removable paddle assembly 84" is constructed from stainless steel to enable cleaning and/or sterilization. The removal of the paddle assembly 84" is achieved by pressing the spring loaded floating lever 86" to release the pressure from the paddle shaft 74".

The alignment of the paddle assembly 84" and of the paddle shaft 74" is achieved by means of a slot 92" machined into the paddle shaft 74", and a tension spring pin 94" installed in a hole provided in the paddle assembly 84".

To avoid the rotation of the paddle shaft 74" when stroke adjustment is necessary, a dowel pin 96" is installed into the paddle shaft 74", according to the orientation of the machined slot 92". The dowel pin 96" slides in a slot 96" machined into a nylon guide 100" which is attached to paddle shaft supports 102" and 104". This feature enables for an easy adjustment of the paddle stroke without compromising the correct orientation of the paddle assembly 84".

In FIG. 6, the rod which supports the door 40 is slightly different than in FIGS. 4 and 5; indeed, the rod 18" in FIG. 6 is covered by a rubber sleeve 106", and the assembly of the rod 18" and the sleeve 106" nests in the trough 70" defined by inverted U-shaped elongated member or channel 68" which is welded to the lower surface of the bottom wall 56 of the door 40.

We claim:

1. A blending device for mixing contents of a bag, comprising a casing defining a chamber and comprising a mixer and a door, wherein when a bag is at least partly positioned in said chamber and said door is closed, said mixer comprising at least one paddle, motor means and transmission means mounted to said paddle, said motor means being adapted to impart motion to said transmission means such as to displace said paddle in a cyclic motion, said paddle being adapted to repeatedly act on the bag and cause a content thereof to be mixed, said paddle including a paddle assembly which comprises a detachable locking mechanism for removably mounting said paddle to said transmission means, whereby said paddle may be disconnected from said transmission means and removed from said casing.

2. A blending device as defined in claim 1, wherein said locking mechanism comprises a pivotable lever displaceable between locking and release positions, wherein, in said locking position, said lever acts on said transmission means to secure said paddle thereto, whereas, in said release position, said lever is sufficiently unlocked from said transmission means to allow said paddle to be detached from said transmission means.

3. A blending device as defined in claim 2, wherein a compression spring is provided between said lever and a base of said paddle assembly fixed to said paddle such that said lever is spring biased toward said locking position.

4. A blending device as defined in claim 3, wherein a shaft of said transmission means extends through said lever with said lever extending, in said locking position, at a first angle with respect to a longitudinal axis of said shaft, whereas, in said release position, said lever extends at a second angle greater than said first angle such as to define a gap between said shaft and edges of said lever which engage said shaft in said locking position.

5. A blending device as defined in claim 1, wherein said door defines a collection container adapted to extend in said chamber when said door is closed and to extend under the bag, whereby at least most of the contents of the bag spilling therefrom while the bag is in said blending device and said door is closed will be collected by said container.

6. A blending device as defined in claim 5, wherein said door is removably connected to said casing.

7. A blending device as defined in claim 6, wherein at least one linkage is provided for connecting said casing to said door, said linkage being pivotally mounted to said casing and to said door at opposed first and second ends thereof respectively, and being detachably connected at said second end to an upper end of said door.

8. A blending device as defined in claim 7, wherein said door defines at a lower end thereof a trough adapted to engage a support rod mounted to said casing and being removable therefrom for allowing said door to be disconnected from said casing.

9. A blending device as defined in claim 7, wherein said second end defines a notch adapted to detachably engage a pin provided on said door.

* * * * *